United States Patent [19]

Juillard

[11] Patent Number: 4,556,089

[45] Date of Patent: Dec. 3, 1985

[54] WEFT-THREAD MIXER DEVICE FOR WEAVING MACHINES

[75] Inventor: Yves Juillard, Mulhouse, France

[73] Assignee: Societe Alsacienne de Construction de Material Textile, France

[21] Appl. No.: 617,168

[22] Filed: Jun. 4, 1984

[30] Foreign Application Priority Data

Jun. 24, 1983 [FR] France ..... 83 10478

[51] Int. Cl.[4] ..... D03D 47/38

[52] U.S. Cl. ..... 139/453

[58] Field of Search ..... 139/68, 71, 72, 453

[56] References Cited

U.S. PATENT DOCUMENTS 3,587,665 6/1971 Monge ..... 139/453

3,731,712 5/1973 Sermet ..... 139/453

4,154,268 5/1979 Schwarz ..... 139/68

*Primary Examiner*—Henry S. Jaudon

*Attorney, Agent, or Firm*—Cantor and Lessler

[57] ABSTRACT

A weft-thread mixer device having: general control means; a rocker connected to each distribution finger; a slide and a pusher for putting the corresponding rocker positively into the active position; a slide and a pusher for putting the same rocker positively into the inactive position; thrust rods for connecting an axle of the general control means selectively to the corresponding slides for putting into the active position or for putting into the inactive position, according to one of the two possible positions of the thrust rods; and individual electromagnets controlling the position of each of the thrust rods. The invention can be used on weaving machines where it is necessary to mix the weft threads.

6 Claims, 4 Drawing Figures

WEFT-THREAD MIXER DEVICE FOR WEAVING MACHINES

The invention relates to weft-thread mixer devices which make it possible to insert different wefts, if appropriate of different colors, which come from a supply source located outside a weaving machine.

Devices of this type conventionally comprise a support which is to be fastened to the machine and on which are mounted: a plurality of feed fingers for the various weft threads, each designed to assume selectively either an advanced active position for feeding a corresponding weft thread or a retracted inactive position; first individual means for positively controlling the transfer of each feed finger into the advanced active position; second individual means for controlling the return of each feed finger towards its retracted inactive position; general means for controling the first individual controlling means mentioned above, which are designed to be connected to the main shaft of the machine so as to operate in synchronism with the said shaft; means of selective connection between the general control means and the first individual control means; and programmed selection control means designed to control the said means of selective connection.

Now, in the known devices of this type, the above-mentioned second individual means for controlling the return of each feed finger towards its retracted inactive position consist of a spring or equivalent means which is released in response to another feed finger being put in the active position. Such a technique is no longer suitable for modern weaving machines working at very high speed, since the feed finger no longer returns to its inactive position quickly enough simply under the action of a spring, and the weft mixer mechanism is no longer capable of following the operating cycle of the weaving machine correctly.

The object of the invention is to overcome the above-mentioned disadvantage of the known devices in question.

For this purpose, according to the invention, the individual means for controlling the return of each feed finger towards its retracted inactive position are likewise means for positive control which are also subjected to the action of the means for selective connection, and each feed finger is connected to a rocker subjected to the programmed opposing actions of the individual means for putting into the active position and into the inactive position respectively.

As result of this new design, the return movements of the weft-thread feed fingers are executed forcibly as quickly as their outgoing movement, this being in perfect synchronism with the other components of the machine, in particular the weft-thread insertion mechanism, that is to say under the best conditions of operating safety.

The invention will be understood more clearly from a reading of the following description and from an examination of the attached drawings which show by way of example an embodiment of the invention.

Figure 1:
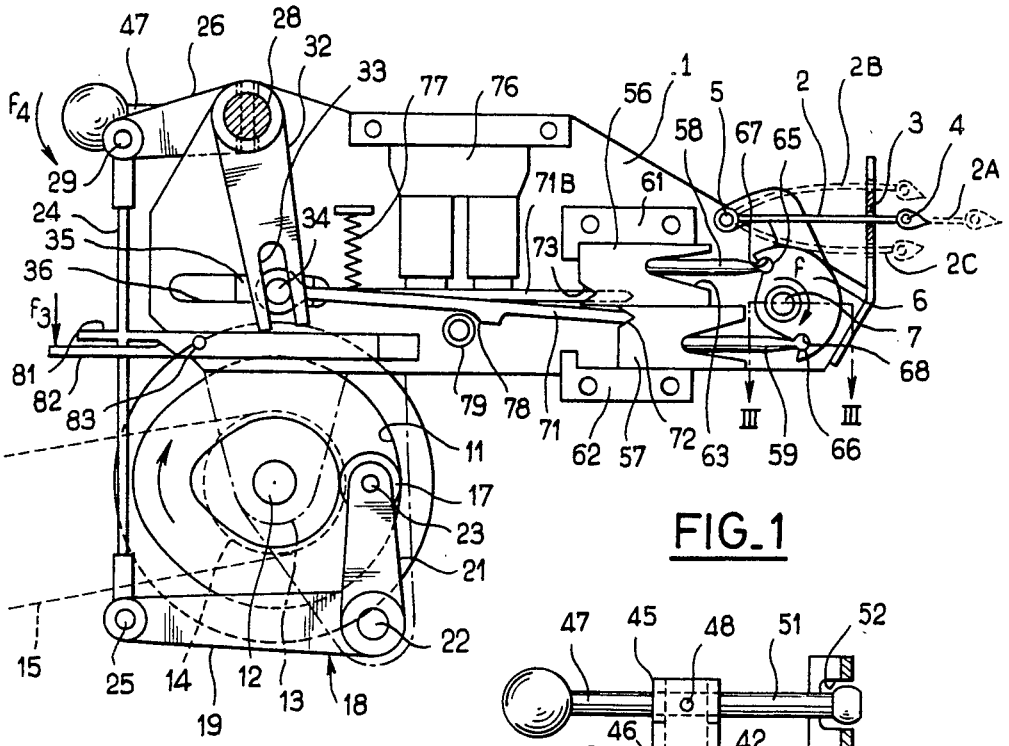
Figure 2:
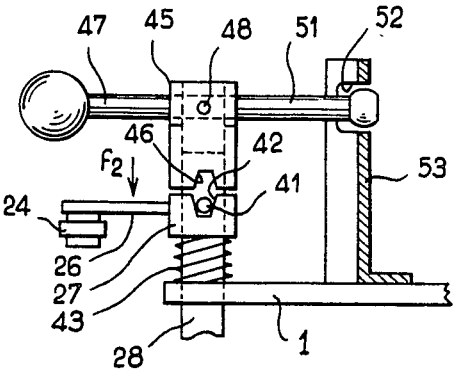
Figure 3:
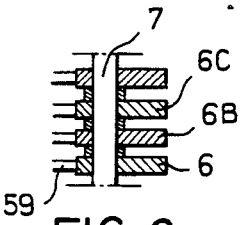
Figure 4:
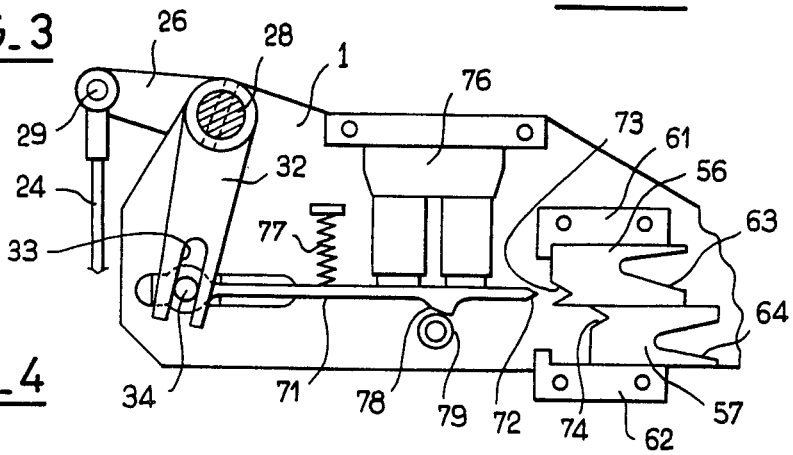

In these drawings:

FIG. 1 is a profile view of a weft-thread mixer device according to the invention, FIG. 2 is a partial plan view showing a detail of the left-hand upper part of FIG. 1, FIG. 3 is a partial horizontal section made along the line III—III of FIG. 1, and FIG. 4 shows the main part of FIG. 1 for a different position of the means for selective connection.

The weft-thread mixer device for a weaving machine, as shown in FIG. 1, is mounted on a support 1 to be fastened to the machine; it comprises a plurality of fingers, such as 2, for feeding the various weft threads, there being, for example, eight of these. The finger 2 can slide in a hole 3 in the support 1, its distal end having an eye 4 for receiving a weft thread, whilst its proximal end is articulated by means of a pin 5 on a rocker 6 which can pivot on an axle 7 carried by the support 1. The finger 2 can assume selectively either a retracted inactive position, which is that shown by unbroken lines in the drawing, or an advanced active position for feeding the corresponding weft thread, which is that shown by broken lines at 2A. It is brought positively from its inactive position into its active position as result of a pivoting movement of the rocker 6 in the direction of the arrow f, and it is returned, likewise positively, from its active position into its inactive position as result of a pivoting movement of the rocker in the opposite direction to that of the arrow f. In the drawing, the finger 2 is shown rectilinear, whilst other fingers, such as 2B and 2C, are shown curved, this being to ensure that the different fingers feed their weft threads substantially at the same location, moreover, if appropriate, several threads at the same time, for example two.

A rocker is associated with each feed finger; thus, rockers 6, 6B and 6C are associated respectively with the different fingers 2, 2B and 2C (see also FIG. 3).

The oscillating movements of the rockers, such as 6, are executed, in response to general control means, by way of means for selective connection and individual control means.

The general control means comprise: a grooved cam 11, a shaft 12 which pivots in a bearing 13 solid with the support 1, and on which the cam 11 is fastened, a toothed pulley 14 also fastened to a shaft 12, a notched belt 15 which passes over the toothed pulley 14 and over another pulley (not shown) connected to the main shaft of the machine, so that the cam 11 rotates in synchronism with the said main shaft of the machine; a roller 17 accommodated in the groove of the cam 11, a lever 18 with two arms 19, 21 which pivots via its apex on an axle 22 also carried by the support 1, an axle 23 which is mounted on the end of the arm 21 and which carries the roller 17, an axle 25 mounted on the end of the other arm 19 of the two-armed lever, a connecting rod 24, one end of which is articulated on the axle 25, a crank 26, of which the hub 27 (see also FIG. 2) is mounted to rotate freely and slide on a shaft 28 which pivots on support 1, an axle 29 which is mounted in the end of the crank 26 and on which the other end of the connecting rod 24 is articulated, another crank 32 which is fastened to the shaft 28 and the end of which has a central groove 33, and a transverse axle 34 which is engaged in the groove 33 and is provided with blocks 35 engaged in a slot 36 in the support 1. The connection between the hub 27 of the crank 26 and the shaft 28 is made by means of a disengageable system which comprises a pin 41 fastened transversely in the shaft 28 and engaged in a diametral groove 42 made in one face of the hub 27 of the crank. A spring 43 interposed on the shaft 28 between the support 1 and the crank hub stresses the latter axially against the pin 41. This system is disengaged as result of a thrust exerted in the direction of the arrow f2 (FIG. 2) on the hub 27 of the crank, counter to the force of the spring 43. For this purpose, there is a mechanism which makes it possible both to disengage the general mechanical control just described and to substitute for it a general manual control. This mechanism comprises: a bush 45 which is also mounted to pivot freely and slide on the shaft 28 next to the hub 27 of the crank 26, and of which the face adjacent to the said hub also has a diametral groove 46 capable of engaging on the pin 41, when the bush 45 is pushed against the hub 27 of the crank, under the action of a handle 47 which is mounted pivotably on a transverse axle 48 fixed in the bush 45 and which has an extension 51, the end of which is engaged in an aperture in the form of an arc of a circle 52 made in a guide 53 which is solid with the support 1 and which is in the form of a portion of a cylindrical surface coaxial with the shaft 28, thus allowing the shaft 28 to pivot by means of the handle previously pushed in the direction of the arrow f2 to disengage the mechanical control.

The individual means for controlling the weft-thread feed fingers have a positive action in both directions. They comprise, for each finger, for example for the finger 2 associated with the rocker 6, a slide 56 for putting into the active position and a slide 57 for putting into the inactive position which are connected to the rocker 6 by two pushers 58 and 59 respectively. The two slides 56 and 57 are mounted to slide in slideways 61, 62 fastened to the support 1. The two pushers 58, 59 are engaged via one of their ends, which is rounded, in the bottom of corresponding rounded notches 63, 64 made in the two slides, and via their other end, in the form of a cylindrical head 65, 66, in bores in the form of corresponding portions of cylindrical surfaces 67, 68 made in the rocker 6.

The means for selective connection between the general control means and the individual means for controlling the feed fingers, which have just beeen described, comprise, for each finger, a thrust rod 71, the proximal end of which is articulated on the axle 34 of the general control means and of which the bevelled distal end 72 (see also FIG. 4) can engage selectively either in a notch 73 of the upper slide 56 for putting the corresponding finger in the active position, when the said thrust rod occupies its upper position shown in FIG. 4, or in a notch 74 of the lower slide 57 for putting the finger in the inactive position, when the thrust rod occupies its lower position, as shown in FIG. 1.

Each thrust rod, such as 71, passes from its lower position into its upper position under the controlling of programmed selection control means. These means comprise, for each thrust rod, an individual electromagnet 76 which is fastened to the support 1 and which is assisted by a spring 77 tending to move the thrust rod away from the poles of the electromagnet. To make the work of the electromagnet easier, there are mechanical means which automatically and positively bring each thrust rod into contact with the poles of the corresponding electromagnet at the end of each retraction movement of the rod. These means comprise a cam 78 on the thrust rod 71, which interacts with a fixed stop 79 solid with the support 1, the locations of the cam on the thrust rod and the stop on the support, as well as the configuration and dimensions of the said cam, being such that only when the thrust rod reaches the end of its retraction travel, under the action of the general control means, is it lifted positively under the effect of the said cam against the poles of the electromagnet 76.

In addition to the programmed selection control means via the electromagnets 76, the device incorporates manual-selection control means in the form of individual selection levers associated with each of the thrust rods; these levers, for example such as 81 or 82, associated with the thrust rods 71, 71B controling the feed fingers 2, 2B respectively, are mounted pivotably on a common axle 83 carried by the support 1 and are located just underneath the corresponding thrust rods. Thus, when a vertical thrust from the top downwards, that is to say in the section of the arrow f3 in FIG. 1, is exerted by hand on the outer end of these levers, the inner end of the lever keeps the corresponding thrust rod 71, 71B raised counter to the restoring spring 77, for as long as the manual thrust is maintained on the lever.

The weft mixer device operates as follows:

It may be assumed that the weaving machine on which it is mounted is in operation and that the last weft which has just been inserted in the shed is that fed by the finger 2B, the thrust rod 71B has just been brought into the advanced position by the cam 11, so that the corresponding components (upper slide, upper pusher and rocker) have been brought into their active position, whilst the other components, that is to say the thrust rods, such as 71, the lower slides, such as 57, and the lower pushers, such as 59, which have also been brought into the advanced position, have placed all the other rockers, such as 6, and, consequently, the corresponding feed fingers in the inactive position (FIG. 1). The cam 11 is driven to rotate in synchronism with the main shaft of the machine, so that, when the boss of the said cam engages against the roller 17, it will push it back, and all the general control means described above will cause the retraction of the common transverse axle 34 and, consequently, the retraction of all the thrust rods, such as 71, and at the end of the travel will cause them to rise against the electromagnets, such as 76, under the effect of the stops 78, as shown in FIG. 4. At this stage of the operating cycle, two hypotheses are to be taken into consideration:

First hypothesis: the weft thread now to be fed is the same as before. The electromagnet associated with the thrust rod 71B controling the same feed finger 2B is energised and thus keeps the said thrust rod lifted against its poles opposite the slide, such as 56, controling the corresponding rocker 6B. Continuation of the rotary movement of the cam 11 therefore brings the roller 17 nearer to the axis of the shaft 12, and all the thrust rods advance simultaneously; the thrust rod 71B alone pushes back an upper slide for putting the finger 2B in the active position, whilst the other thrust rods, brought into the lower position by their restoring springs 77 in the absence of attraction by the other electromagnets, do not find anything in front of them, since the lower slides, such as 57, for putting the fingers other than the finger 2B in the inactive position, have already been advanced in the preceding cycle. At the next passage of the boss of the cam 11 against the roller 17, all the thrust rods retract, and then rise at the end of the travel, this having no effect on the slides and the rockers, since the distal ends of the thrust rods simply move away from the slides.

Second hypothesis: the weft thread to be fed is a thread other than that which has just been fed by the finger 2B, for example that threaded in the eye of the finger 2. In this case, it is the electromagnet 76 associated with the thrust rod 71 which is energised; it keeps this rod in the raised position (FIG. 4), while the continuation of the rotary movement of the cam 11 causes all the thrust rods to advance. The rod 71 alone, maintained in the upper position by the electro-magnet, will push back the upper slide 56 for putting the finger 2 in the active position, whilst all the other thrust rods, lowered by their restoring springs 77 in the absence of any energising current in corresponding electro-magnets, advance at the level of the lower slides, such as 57, and, in particular, the thrust rod 71B encounters the lower slide for putting into the inactive position the rocker 6B which had just been put in the active position for the movement of insertion of the preceding weft; the other thrust rods in the lower position do not encounter anything in front of them, since the corresponding lower slides were already in the advanced position because the corresponding rockers were put in the inactive position.

In general terms, it may be said that, at the appropriate time, each rocker is put into the active position positively under the action of a thrust rod in the upper position, and that it is put into the inactive position, also automatically and positively, under the action of the same thrust rod in the lower position. It can also be said that each rocker is brought into the inactive position when another rocker is subsequently brought into the active position, so that any feed finger remains permanently in the active position as long as the weft thread which it controls is to be inserted several times in succession.

The manual selection control is used as follows:

If the thrust rods 71 are not in their retracted position shown in FIG. 4, they are first brought into this position; for this purpose, the handle 47 (FIG. 2) is grasped and pulled in the direction of the arrow f2, and the bush 45 pushes back the hub 47 belonging to the general control means and engages via its groove 46 on the pin 41. From that moment on, this handle is solid in terms of rotation with the shaft 28. That of the levers, such as 81 or 82 (FIG. 1), which corresponds to the feed finger for the desired weft thread is pressed, in order to lift the corresponding thrust rod, such as 71, and then a rotary movement in the direction of the arrow f4 (FIG. 1) is imparted to the handle, during which time its inner end slides in the fixed aperture 52, in order to advance the common transverse axle 34 retained in the crank 32 solid with the shaft 28. The selected thrust rod maintained in the upper position pushes back the upper slide for putting the corresponding rocker in the active position, whilst, if appropriate, the other thrust rods push back the lower slide for restoring to the inactive position a rocker previously put in the active position. Finally, the manual control is returned to rest, that is to say, on the one hand, the lever, such as 81, is released and, on the other hand, the handle 47 is pivoted again in the opposite direction so as to bring the shaft 28 back into its angular position, in which the pin 41 can resume its normal place in the hub 27 which is pushed back by the spring 43 after the handle 47 has been released completely. The mixer mechanism is then ready again to operate on automatic control.

I claim:

1. A weft thread mixer device for weaving machines comprising a support to be fastened to the machines and on which are mounted:

(A) a plurality of feed fingers intended for the various weft threads and each designed to assume selectively either an advanced active position for feeding a corresponding weft thread or a retracted inactive position;

(B) a plurality of rockers pivotally mounted on said support and respectively operatively connected to said feed fingers to move said fingers selectively either into said advanced active position or into said retracted inactive position;

(C) first individual control means for positively controlling the transfer of each said feed finger into said advanced active position, comprising a plurality of first slides for selectively putting corresponding feed fingers into said active position;

(D) second individual control means for positively controlling the return of each said feed finger towards said retracted inactive position, comprising a plurality of second slides for selectively putting corresponding feed fingers into said inactive position;

(E) said first and second slides being mounted on said support for parallel adjacent reciprocating movement and being respectively operatively connected to said rockers;

(F) selective connection means comprising a plurality of thrust rods each having a proximal end and a distal end, said proximal end being mounted on said support for longitudinal reciprocating movement in a direction parallel with the direction of movement of said slides, while said distal end is adapted to be positioned selectively either in an active position or in an inactive position facing selectively the corresponding first slide or the corresponding second slide to push either of said corresponding slides;

(G) general control means operatively connecting said proximal ends of said thrust rods with the main shaft of said machine to reciprocate said thrust rods in synchronism with said main shaft; and (H) programmed selection control means also mounted on said support for bringing said distal ends of said thrust rods selectively into either of their two positions.

2. A device as claimed in claim 1, wherein the selection control means consist of a plurality of individual electromagnets equal in number to the thrust rods, which are located in the immediate vicinity of the respective thrust rods and which are designed to attract them selectively so as to keep them temporarily in the active position.

3. A device as claimed in claim 2, wherein each thrust rod is normally biased towards its inactive position.

4. A device as claimed in claim 2, wherein each thrust rod is provided with a cam which interacts with a stop fixed to said support; the locations of the cam on the thrust rod and of the stop on the support, as well as the configuration and dimensions of the said cam, being such that only when the rod reaches the end of its retraction travel under the action of the general control means is it pushed positively under the effect of the said cam against the corresponding selection electromagnet.

5. A device as claimed in claim 1, which further comprises means for disengaging the general control means, means for the manual control of said selective connection means, and manual selection control means.

6. A device as claimed in claim 5, wherein said thrust rods are operatively connected to a drive axle, the means for manual control of the means for selective connection comprises a handle for actuating said drive axle, and wherein the manual selection control means comprise individual levers for putting said thrust rods selectively into the active position.

* * * * *